US012753560B2

(12) United States Patent
James et al.

(10) Patent No.: US 12,753,560 B2
(45) Date of Patent: Oct. 6, 2026

(54) SINGLE-SWITCH SNOW THROWER AND POWER TOOLS INCLUDING METHODS OF OPERATION

(71) Applicant: Techtronic Cordless GP, Anderson, SC (US)

(72) Inventors: Thomas Kolangayil James, Greenville, SC (US); Michael Scott Bailey, Powdersville, SC (US); Shuai Shao, Simpsonville, SC (US); Christian Rudolph Williams, Greenville, SC (US)

(73) Assignee: TECHTRONIC CORDLESS GP, Anderson, SC (US)

( * ) Notice: Subject to any disclaimer, the term of this patent is extended or adjusted under 35 U.S.C. 154(b) by 255 days.

(21) Appl. No.: 18/503,603

(22) Filed: Nov. 7, 2023

(65) Prior Publication Data

US 2024/0159005 A1 May 16, 2024

Related U.S. Application Data

(60) Provisional application No. 63/424,283, filed on Nov. 10, 2022.

(51) Int. Cl.
*E01H 5/04* (2006.01)
*E01H 5/09* (2006.01)

(52) U.S. Cl.
CPC ..... *E01H 5/045* (2013.01); *E01H 5/098* (2013.01)

(58) Field of Classification Search
CPC ..... E01H 5/045; E01H 5/098
USPC ..... 37/196
See application file for complete search history.

(56) References Cited

U.S. PATENT DOCUMENTS

| | | | | |
|---|---|---|---|---|
| D408,770 | S | 4/1999 | Colquitt | |
| 6,453,583 | B1 | 9/2002 | Hanafussa et al. | |
| D500,053 | S | 12/2004 | Yuzuriha et al. | |
| 7,487,608 | B2 | 2/2009 | Yamazaki et al. | |
| 7,866,068 | B2 | 1/2011 | Van Buren et al. | |
| 9,567,019 | B2 | 2/2017 | Keller | |
| 10,214,869 | B1 | 2/2019 | Krajewski et al. | |
| 10,464,587 | B2 * | 11/2019 | Schmalz | E01H 5/045 |
| 10,625,797 | B2 | 4/2020 | Maile et al. | |
| 2006/0096134 | A1 * | 5/2006 | Mercer | E01H 5/045 37/244 |
| 2015/0068074 | A1 * | 3/2015 | Mast | E01H 5/098 37/197 |

(Continued)

FOREIGN PATENT DOCUMENTS

| | | |
|---|---|---|
| CN | 3570918 | 10/2006 |
| CN | 204845497 U | 12/2015 |

(Continued)

OTHER PUBLICATIONS

European Search Report Corresponding to Application No. 23208675 on Mar. 26, 2024.

*Primary Examiner* — Muhammad Shafi
(74) *Attorney, Agent, or Firm* — Dority & Manning, P.A.

(57) ABSTRACT

A snow thrower, power tool, or method of operation may include detecting switch engagement at a single tool activation switch. A method may also include directing element rotation for a rotatable work element in response to detecting switch engagement. The method may further include directing wheel rotation for one or more drive wheels in response to detecting switch engagement.

20 Claims, 7 Drawing Sheets

(56) References Cited

U.S. PATENT DOCUMENTS

| | | | | |
|---|---|---|---|---|
| 2015/0218764 | A1* | 8/2015 | Schisel | E01H 5/098 37/260 |
| 2017/0101756 | A1 | 4/2017 | Zhang et al. | |
| 2017/0247847 | A1* | 8/2017 | Maile | B62B 17/02 |
| 2017/0267297 | A1* | 9/2017 | Maile | E01H 5/045 |
| 2019/0187693 | A1* | 6/2019 | Towers | B60K 25/02 |
| 2021/0408946 | A1* | 12/2021 | Ding | E01H 5/098 |
| 2022/0243412 | A1* | 8/2022 | O'Brien | E01H 5/045 |

FOREIGN PATENT DOCUMENTS

| | | | | |
|---|---|---|---|---|
| CN | 205276205 | U | | 6/2016 |
| CN | 111794169 | A | | 10/2020 |
| CN | 212335881 | U | | 1/2021 |
| CN | 112796267 | A | | 5/2021 |
| CN | 112796268 | A | | 5/2021 |
| CN | 213508258 | U | | 6/2021 |
| CN | 214460055 | U | | 10/2021 |
| CN | 214783583 | U | | 11/2021 |
| CN | 216586359 | U | | 5/2022 |
| EM | 000051180-0001 | | | 12/2003 |
| EM | 000075114-0001 | | | 12/2003 |
| EP | 2806069 | B1 | | 4/2016 |
| EP | 3001073 | B1 | | 5/2017 |
| JP | 2022113638 | A | * | 11/2022 |
| WO | WO2018193425 | A1 | | 10/2018 |

* cited by examiner

SINGLE-SWITCH SNOW THROWER AND POWER TOOLS INCLUDING METHODS OF OPERATION

CROSS-REFERENCE TO RELATED APPLICATIONS

The present application claims the benefit of priority to U.S. Provisional Patent Application No. 63/424,283, filed on Nov. 10, 2022, the disclosure of which is incorporated by reference herein in its entirety.

FIELD

The present disclosure relates generally to power tools, such as snow throwers. More particularly, the present disclosure relates to methods for operating such power tools or snow throwers.

BACKGROUND

Power tools are generally utilized to make working conditions easier. For example, snow throwers eliminate the need for shoveling snow. Instead of manually lifting snow from a surface (e.g., a driveway or sidewalk) to move the snow therefrom, the operator can push or walk a snow thrower through the snow. The snow thrower lifts the snow and discharges it a distance from the underlying surface. In this regard, snow throwers make snow removal easier than previous manual operations.

Some power tools include multiple movable elements that can move or rotate separately from each other (e.g., as driven by separate motors). For instance, some snow throwers include both a powered auger driven by an auger motor and one or more powered wheels that are driven by a wheel motor. Since the separate elements generally serve different purposes (e.g., moving snow or propelling the tool along a surface), it may be useful to drive or activate such elements at different times. As an example, a user may wish to start (or continue to rotate) an auger without immediately activating the powered wheels. Existing tools have attempted to address this issue by have separate grip controls for each element/motor. Specifically, one grip control is provided to activate one element (e.g., the auger) while another grip control is provided to activate another element (e.g., the wheels).

BRIEF DESCRIPTION

Although existing power tools may permit separate activation or control of separate elements, they present some drawbacks. For instance, the increased complexity of two independent grip controls may increase the cost or difficulties for tool production. Moreover, as the number of parts or assemblies increases, the number of potential failure points also increases. Additionally or alternatively, although some level of separate control for different elements may be desirable, a user may become confused and have difficulty remembering which control corresponds to which element. What's more, situations may arise when an immediate stop to both elements is desirable, which may be complicated or foiled by the use of separate grip controls.

Accordingly, improved tools or methods of operation are desired in the art. In particular, systems or methods that provide a single activation control for multiple elements or otherwise improve durability, assembly, or safety of a power tool would be advantageous.

Aspects and advantages of the invention in accordance with the present disclosure will be set forth in part in the following description, or may be obvious from the description, or may be learned through practice of the technology.

In accordance with one embodiment, a method of operating a snow thrower is provided. The method may include detecting switch engagement at a single tool activation switch. The method may also include directing auger rotation for a rotatable auger in response to detecting switch engagement. The method may further include directing wheel rotation for one or more drive wheels in response to detecting switch engagement.

In accordance with another embodiment, a method of operating a power tool is provided. The method may include detecting switch engagement at a single tool activation switch. The method may also include directing element rotation for a rotatable work element in response to detecting switch engagement. The method may further include directing wheel rotation for one or more drive wheels in response to detecting switch engagement.

In accordance with yet another embodiment, a method of operating a snow thrower is provided. The method may include detecting switch engagement at a single tool activation switch. The method may also include directing auger rotation for a rotatable auger based on an element speed input in response to detecting switch engagement. The method may also include directing wheel rotation for one or more drive wheels based on a wheel speed input in response to detecting switch engagement based on an element speed input. The method may further include detecting switch release at the single tool activation switch. The method may still further include halting auger rotation in response to detecting switch release and halting wheel rotation in response to detecting switch release.

These and other features, aspects and advantages of the present invention will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present invention, including the best mode of making and using the present systems and methods, directed to one of ordinary skill in the art, is set forth in the specification, which makes reference to the appended figures, in which.

DETAILED DESCRIPTION

Figure 1:
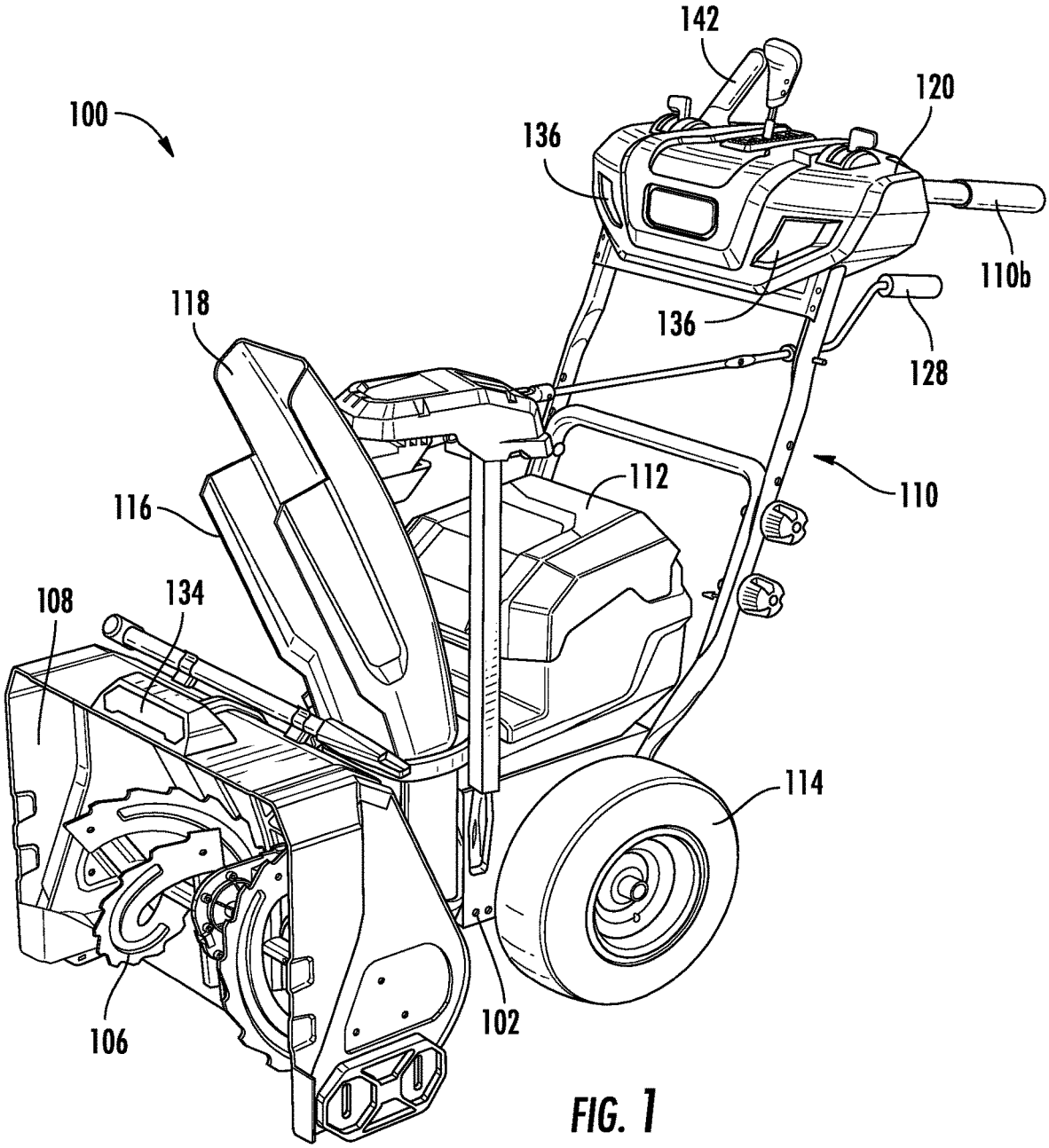
FIG. 1 is a front perspective view of a snow thrower in accordance with embodiments of the present disclosure.

Reference now will be made in detail to embodiments of the present invention, one or more examples of which are illustrated in the drawings. The word "exemplary" is used herein to mean "serving as an example, instance, or illustration." Any implementation described herein as "exemplary" is not necessarily to be construed as preferred or advantageous over other implementations. Moreover, each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive- or and not to an exclusive- or. For example, a condition A or B is satisfied by any one of the following: A is true (or present) and B is fake (or not present), A is fake (or not present) and B is true (or present), and both A and B are true (or present).

Terms of approximation, such as "about," "generally," "approximately," or "substantially," include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

In general, power tools or methods of operating the same in accordance with one or more embodiments of the present disclosure can provide control steps or schemes for controlling multiple discrete powered elements, such as a rotatable work element (e.g., auger or blade) and one or more self-propelled wheels. Exemplary power tools include snow throwers. A single tool activation switch may be provided for a user to grasp and activate the multiple powered elements. Thus, a user may be able to use a single hand to control or activate multiple elements.

Figure 2:
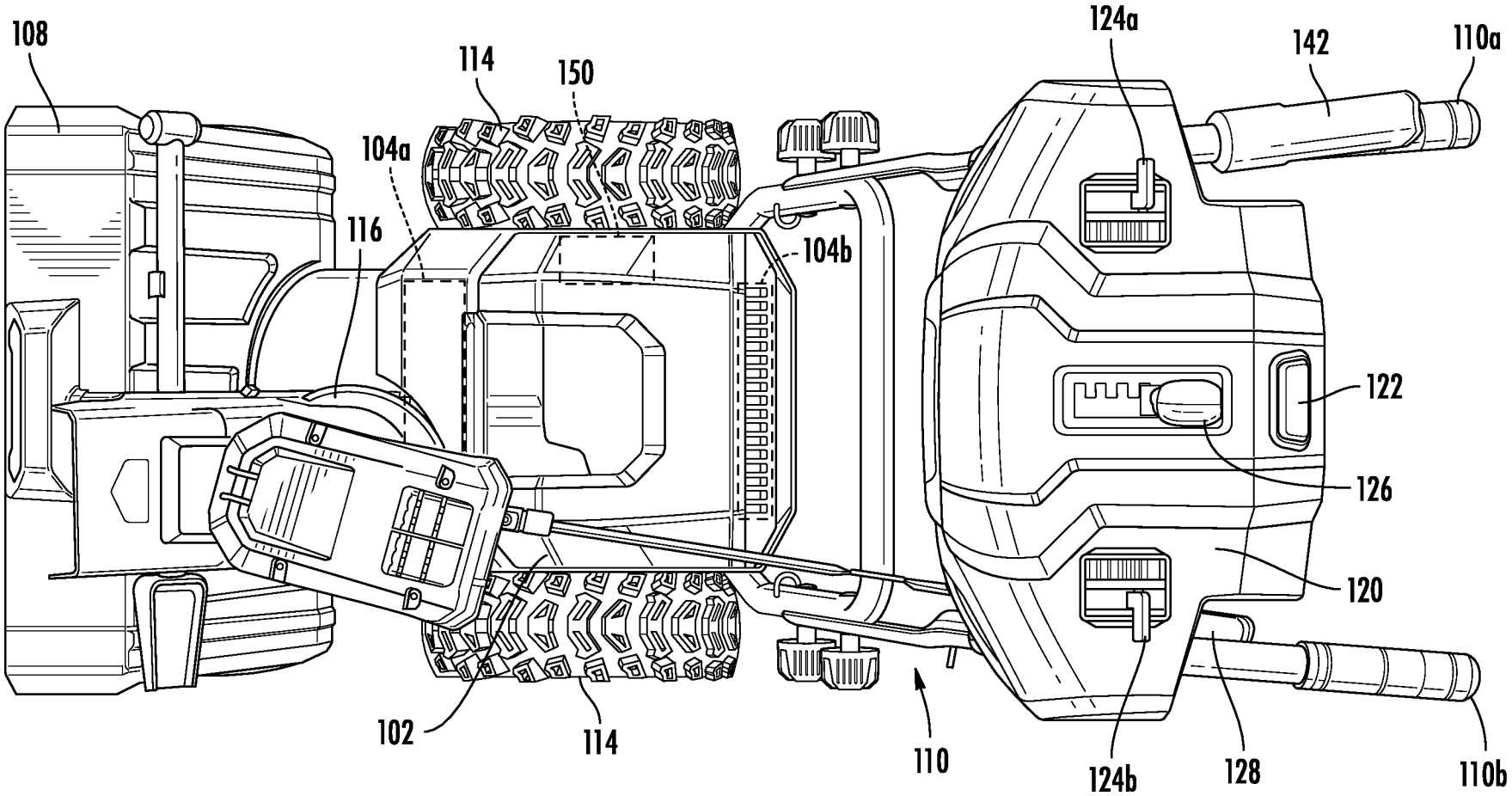
FIG. 2 is a top plan view of the exemplary snow thrower of FIG. 1.
Figure 3:
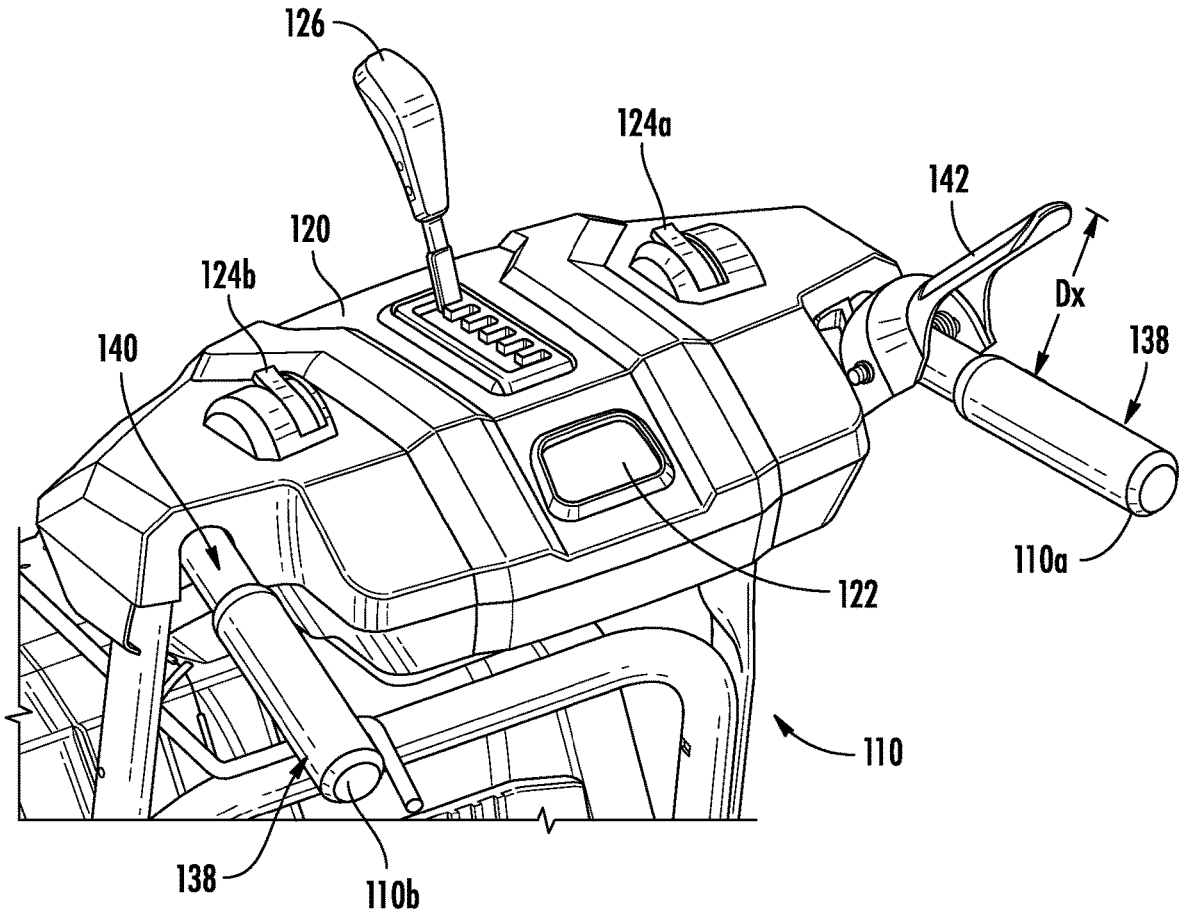
FIG. 3 is a perspective view of a portion of the exemplary snow thrower of FIG. 1.
Figure 4A:
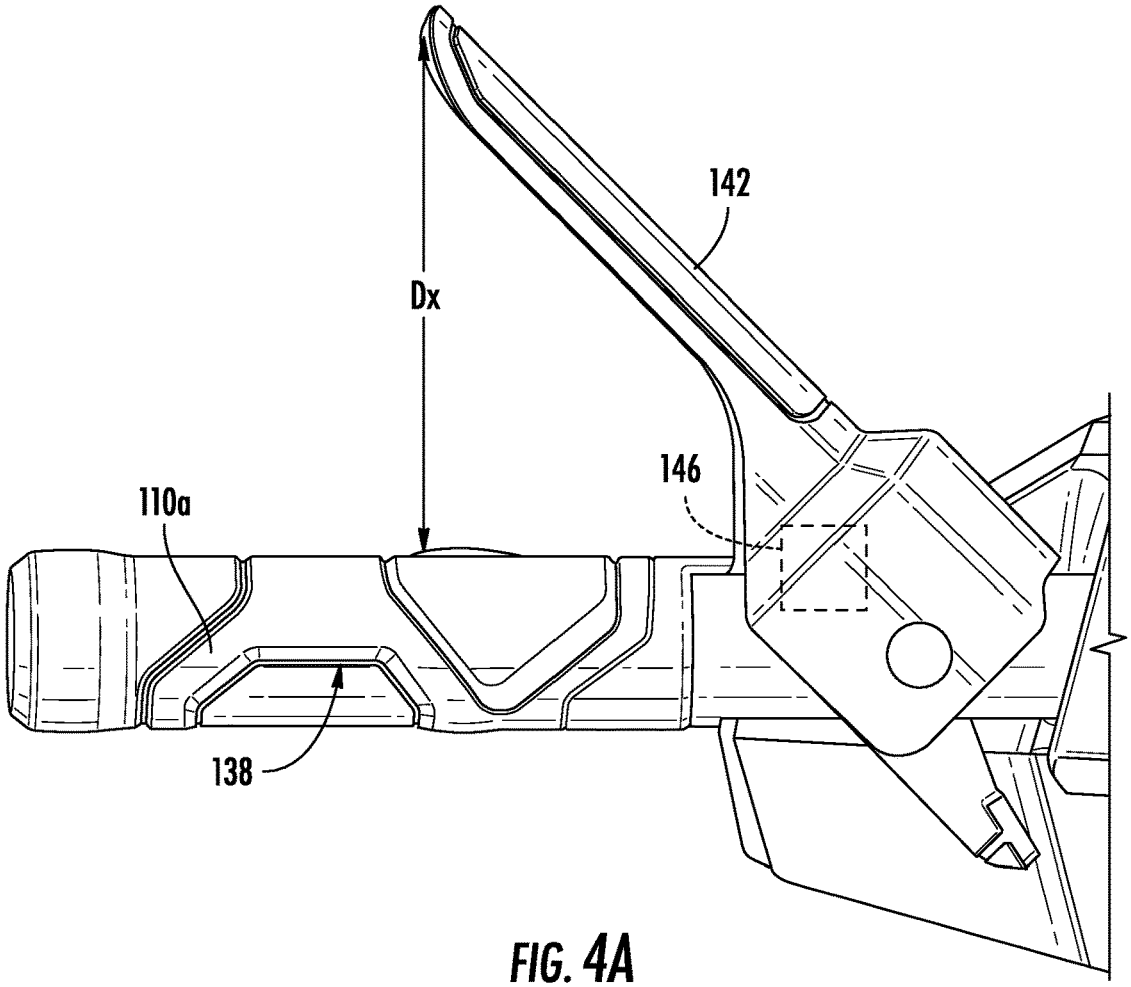
FIG. 4A is a side elevation view of a first handle and single tool activation switch of the exemplary snow thrower of FIG. 1, wherein the single tool activation switch is in a disengaged position.
Figure 4B:
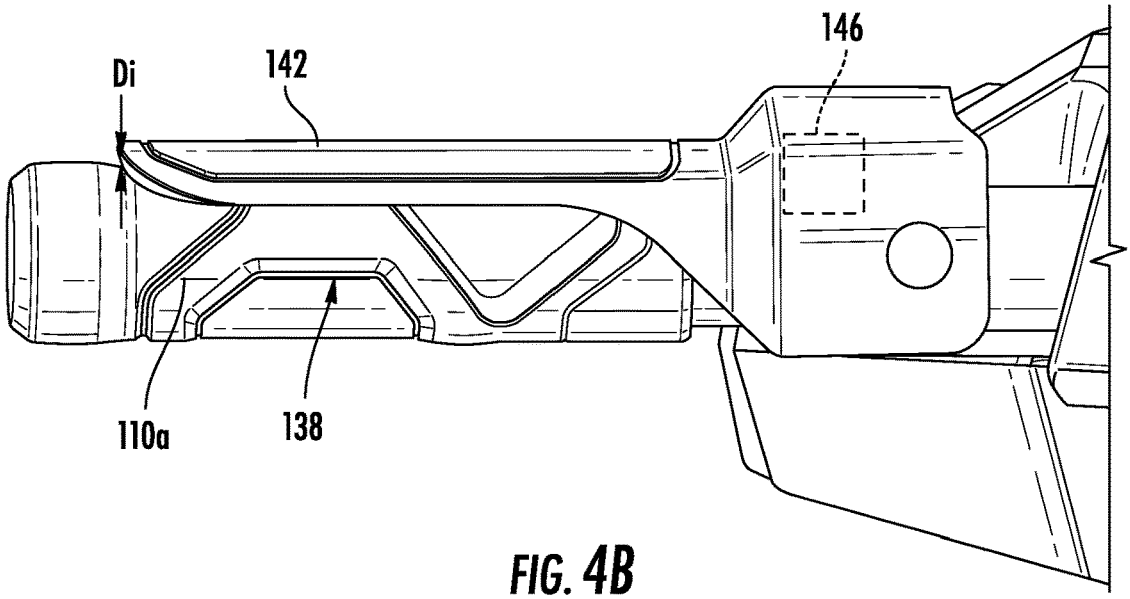
FIG. 4B is a side elevation view of a first handle and single tool activation switch of the exemplary snow thrower of FIG. 1, wherein the single tool activation switch is in an engaged position.

Referring now to the drawings, FIGS. 1 and 2 illustrate a snow thrower 100 in accordance with an exemplary embodiment of the present disclosure. The snow thrower 100 generally includes a frame 102, one or more motors 104 (e.g., element motor 104*a* or wheel motor 104*b*), a work element such as an auger 106 coupled (e.g., rotatably mounted) to the frame 102, such as disposed in an auger housing 108, and a handle assembly 110 extending from the frame 102. As illustrated, the handle assembly 110 can extend from a rear end of the frame 102 in a generally vertical direction. A battery compartment 112 can be coupled to the frame 102 to receive one or more batteries (not illustrated) which can provide power to the one or more motors 104*a*, 104*b* (e.g., one more electric motors). In other embodiments, motors 104 can include an engine powered by fuel. In such embodiments, the battery compartment 112 can be replaced or supplemented with a fuel storage tank (not illustrated) which stores fuel for powering the engine.

In some embodiments, a controller 150 may be provided in operative communication with one or more components of snow thrower (e.g., motors 104*a*, 104*b*, speed inputs 124*a*, 124*b*, power button 122, single tool activation switch 142, etc.). The controller 150 may include a memory and one or more microprocessors, CPUs or the like, such as general or special purpose microprocessors operable to execute programming instructions or micro-control code associated with operation of snow thrower 100. The memory may represent random access memory such as DRAM, or read only memory such as ROM or FLASH. In some embodiments, the processor executes non-transitory programming instructions stored in memory. For certain embodiments, the instructions include a software package configured to operate snow thrower 100 or execute an operation routine (e.g., the exemplary method 500 described below with reference to FIG. 5). The memory may be a separate component from the processor or may be included onboard within the processor. Alternatively, controller 150 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 150 may be positioned in a variety of locations throughout snow thrower 100. Input/output ("I/O") signals may be routed between controller 150 and various operational components of snow thrower 100. One or more components of snow thrower 100 may be in operative communication (e.g., electric communication) with controller 150 via one or more conductive signal lines or shared communication busses.

The snow thrower 100 is supported by walking elements, e.g., wheels 114. In some embodiments, the wheels 114 are provided as a pair of driven wheels that can be driven or rotated by a discrete wheel motor 104*b* (e.g., separate from element motor 104*a*). As illustrated, the wheel motor 104*b* may be supported on the frame 102 apart from the element motor 104*a*. Although the driven wheels 114 may be motivated or rotated by wheel motor 104*b*, an operator or user may selectively push the snow thrower (e.g., manually), as will be described below.

The snow thrower 100 can include one or more lighting elements (e.g., one or more light emitting diodes, commonly referred to as LEDs) configured to illuminate one or more areas of the environment in which the snow thrower 100 is operating. For example, the snow thrower 100 can include a first light 134 disposed on the auger housing 108. By way of another example, the snow thrower 100 can include a second light 136 disposed on the control platform 120. In some instances, at least one of the first and second lights 134 and 136 can automatically turn on when the snow thrower 100 is in use. In other instances, at least one of the first and second lights 134 and 136 can be manually actuatable, e.g., at control located on the control platform 120.

The auger housing 108 can be in communication (e.g., fluid communication) with a chute 116. Moreover, the auger housing 108 can be connected with the chute 116 mechanically, electrically, or both. The chute 116 can extend, for example, above the auger housing 108. The chute 116 can direct discharged snow in a desired direction. In an embodiment, the chute 116 can rotate about a vertical axis. The chute 116 can include a moveable interface 118 configured to rotate the discharge direction about a horizontal axis. In this regard, the direction and height of discharged snow can be controlled. In certain instances, the direction of at least one of the chute 116 and moveable interface 118 can be controlled by the operator at the handle assembly 110. For instance, a chute lever 126 may be provided on the handle assembly 110 (e.g., at a control platform 120) to selectively rotate the chute 116. Additionally or alternatively, a movable flap arm 128 may be provided on the handle assembly 110 (e.g., below the control panel 120, as illustrated, or alternatively on the control panel 120) to selectively rotate the movable interface 118.

In certain embodiments, handle assembly 110 include a pair of discrete handles 110*a*, 110*b*. In other words, handle assembly 110 may include a first handle 110*a* and a second handle 110*b* (e.g., laterally) spaced apart from each other. As shown, the handles 110*a*, 110*b* may separately extend from frame 102. In some instances, the first and second handles 110*a* and 110*b* can form a single piece, i.e., the first and second handles 110*a* and 110*b* can each be part of a single-piece construction handle having left and right portions to receive a user's left and right hands, respectively. In other instances, the handle assembly 110 can include a multi-piece construction. In multi-piece embodiments, the first and second handles 110*a* and 110*b* can each include discrete, separate components coupled together. The first and second handles 110*a* and 110*b* can be coupled to one or more additional portions, which extend from the frame 102 to the first and second handles 110*a* and 110*b* (e.g., to support the handles 110*a* and 110*b* or permit selective height adjustments or storage configurations of the handle assembly 110).

As shown, handle assembly 110 may include a control platform 120. Generally, control platform 120 is disposed or held above the frame 102 and wheels 114. In the illustrated embodiments, control platform 120 extends (e.g., laterally) between the two handle 110*a*, 110*b*. The control platform 120 generally include one or more controls associated with controlling operational aspect(s) of the snow thrower 100. By way of non-limiting example, the control platform 120 can include a power button 122 and one or more speed inputs (e.g., element speed input 124*a* and wheel speed input 124*b*) operably coupled to a controller 150. One or more position sensors (e.g., a potentiometer, Hall effect sensor, infrared proximity sensor, capacitive displacement sensor, inductive sensor, eddy-current sensor, photodiode array, etc.) may be attached to or in operable communication with each speed input 124*a*, 124*b* to detect the relative position of an input (e.g., on control platform 120) and communicate the same (e.g., to a controller 150).

Generally, each speed input 124*a* and 124*b* defines a set range of motion (e.g., pivoting motion) between a predefined maximum and minimum. For instance, the element speed input 124*a* may define a range of motion corresponding to a range of rotational speeds between a top speed (e.g., as defined by RPM or power draw) and a base speed (e.g., as defined by RPM or power draw). The top speed of auger 106 may be set as the maximum of the range of motion, while the base speed may be set as the minimum range of motion of element speed input 124*a*.

Figure 6:
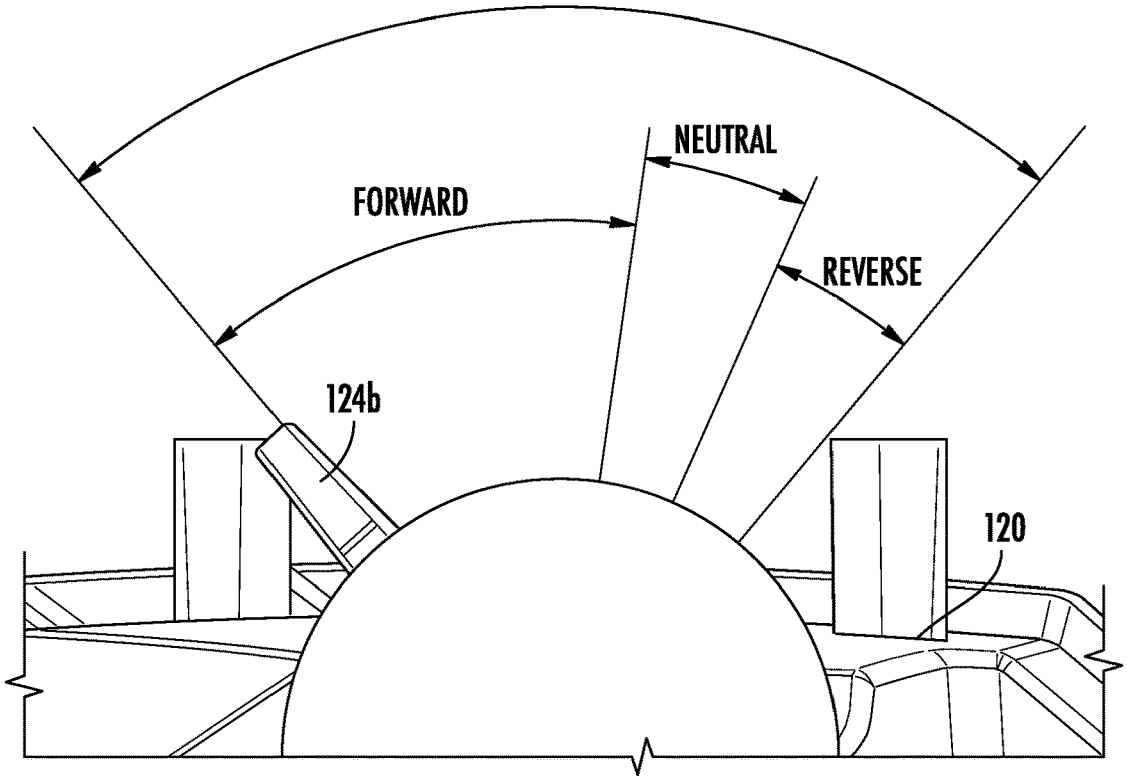
FIG. 6 is a side elevation view of a wheel speed input of the exemplary snow thrower of FIG. 1.

Separately from or in addition to the element speed input 124*a*, the wheel speed input 124*b* may define a range of motion corresponding to a range of rotational speeds between a top speed (e.g., as defined by RPM or power draw) and a base speed (e.g., as defined by RPM or power draw). In optional embodiments, a reverse speed (or range) may further be defined, as shown in FIG. 6. For instance, top speed of the wheels 114 may be set as the maximum of the range of motion, while the reverse speed may be set as the minimum range of motion of wheel speed input 124*b*. The base speed (i.e., minimum forward speed) may be set at a position between the maximum and the minimum range of motion of wheel speed input 124*b*. In further optional embodiments, a neutral position corresponding to a negligible or nonexistent power draw (i.e., a wheel speed of 0) may set at a position between the maximum and the minimum range of motion of wheel speed input 124*b* (e.g., specifically between the minimum forward speed position and the minimum range of motion).

Figure 7:
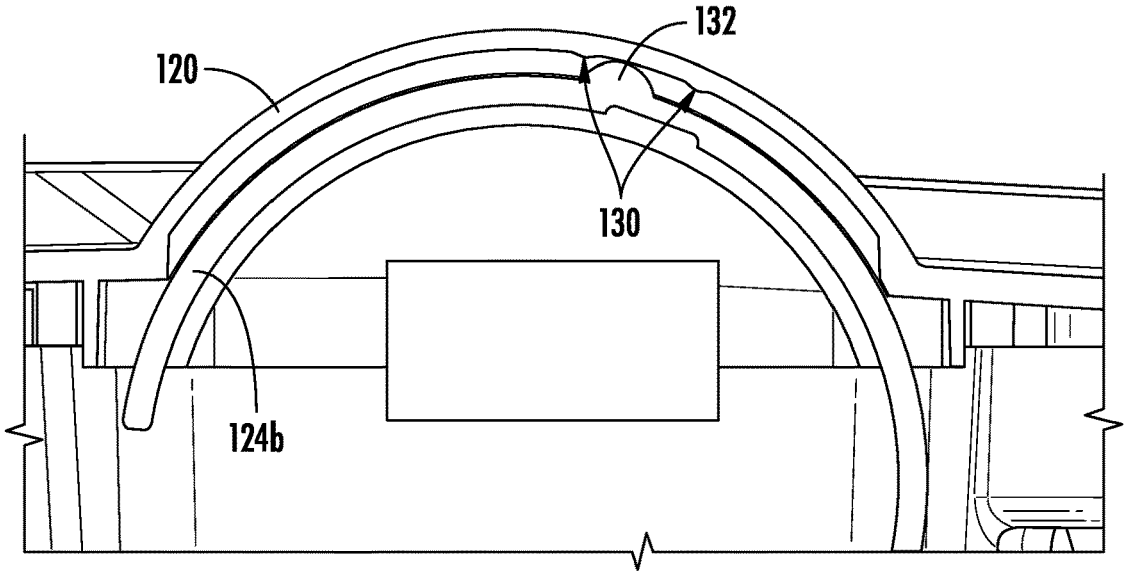
FIG. 7 is a side sectional view of a portion of the speed input of the exemplary snow thrower of FIG. 1.

Turning briefly to FIG. 7, wheel speed input 124*b* may include one or predefined stops or retention indents to selectively hold wheel speed input 124*b* at a predefined point or region along the set range of motion. For instance, a pair of retention indents 130 may be formed at the bounds of neutral position. In some embodiments, a pair retention indents 130 are formed as enlarged ridges or prongs extending radially inward or down from a portion of control platform 120 to selectively engage a mated retention ridge 132 formed on an interior body of wheel speed input 124*b* and extending radially outward or up to engage a downward facing surface of control platform 120. In the illustrated embodiments, the pair of retention indents 130 are static relative to control platform 120 while mated retention ridge 132 is movable with wheel speed input 124*b* relative to control platform 120. Thus, as wheel speed input 124*b* is pushed or pulled to move along the set range of motion, the mated retention ridge 132 may engage the pair of retention ridges 130 at the limits of the forward range and the reverse range. The friction or engagement between the retention ridges 130, 132 may thus require additional force from a user to move between the forward and reverse ranges. Moreover, the pair of ridges 130 may selectively hold the mated retention ridge 132, and thus the wheel speed input 124*b*, in the neutral position (e.g., by friction). In some embodiments, the additional amount of user force needed to move either of ridges 130 past ridge 132 is not significant but provides a mechanical indication to a user that the lever has moved into a different zone (e.g., forward, neutral, reverse) as the ridges interact.

Returning now to FIGS. 1 through 4B, when using the snow thrower 100, the operator generally holds or guides the handle assembly 110, e.g., the first and second handles 110*a* and 110*b* of the handle assembly 110, to maintain the snow thrower 100 oriented and moving in a desired direction. The handle assembly 110 can form two separate gripping areas—a first gripping area 138 and a second gripping area 140. The first and second gripping areas 138 and 140 can be spaced apart from one another (e.g., laterally). For example, the first gripping area 138 can be associated with the first handle 110*a* of the handle assembly 110 and the second gripping area 140 can be associated with the second handle 110*b* of the handle assembly 110.

In the illustrated embodiment, the operator grasps the gripping areas 138 and 140 by wrapping their hands around the gripping areas 138 and 140. The first gripping area 138 includes a single tool activation switch 142 which is moveable relative to the handle assembly 110, and more particularly moveable relative to the first handle 110*a* of the handle assembly 110. As shown, the second gripping area 140 can form a passive gripping area which is grasped by the operator to control, e.g., a direction of, the snow thrower 100 but which does not include an actuatable member, switch, or paddle.

Single tool activation switch 142 (e.g., the movement thereof) defines at least two discrete positions. Specifically, single tool activation switch 142 defines a disengaged position (e.g., FIG. 4A) and an engaged position (e.g., FIG. 4B). As shown, the disengaged position defines a maximum distance Dx between the single tool activation switch 142 and the first handle 110*a* (e.g., when a user has not grasped or actuated single tool activation switch 142). By contrast, the engaged position generally provides single tool activation switch 142 and thus defines a minimum distance Di between the single tool activation switch 142 and the first handle 110*a* (e.g., when a user has grasped or actuated single tool activation switch 142). An activation sensor 146 (e.g., reed sensor, normally open electric switch, or a suitable position sensor) may be in selective operative engagement with single tool activation switch 142. For instance, switch sensor 146 may be located or configured to detect if and when single tool activation switch 142 is in the engaged position and communicate the same (e.g., to the controller 150). In one or more embodiments, the single tool activation switch 142 can be spring-biased to the disengaged position (e.g., via a torsion spring mounted to handle assembly 110) such that the single tool activation switch 142 automatically returns to the disengaged position upon release.

The single tool activation switch 142 can advantageously direct one or more operational aspects of the snow thrower 100. For instance, engagement with the single tool activation switch 142 can direct or initiate rotation of the auger 106, rotation of the wheels 114, or the like. Optionally, actuating the single tool activation switch 142 to the engaged position can engage the auger 106 and wheels 114 to both rotate. Alternatively, actuating the single tool activation switch 142 to the engaged position can engage the wheels 114 to rotate (e.g., according to or based on the position of a wheel speed input 124*b*), while rotation of the auger 106 is prevented until a separate input (e.g., the power button 122) is also engaged. The speed or direction of the auger 106 and wheels 114 can be dictated, for instance, by the relative position of the element speed input 124*a* and the wheel speed input 124*b*, respectively. The auger 106 and wheels 114 can continue to rotate until the single tool activation switch 142 is released or returned to the disengaged position (or otherwise moved from the engaged position). It is noted that although the single tool activation switch 142 is arranged on the right handle 110*a* in the present drawings, it is understood that alternative embodiments could provide single tool activation switch 142, e.g., the left handle 110*b*, without deviating from the present disclosure.

In the illustrated embodiments, the single tool activation switch 142 is illustrated as a pivotable paddle that is pivotable between the expanded disengaged position and the compressed engaged position. Nonetheless, as would be understood, single tool activation switch 142 may be provided as another suitable input (e.g., having a set range of motion or configured variation between a disengaged position and an engaged position, which includes a disengaged state and an engaged state if no moving elements are provided), such as a button, capacitive trigger pad, twist-grip or twist throttle, or bail. Generally, though, the single tool activation switch 142 is understood to be actuatable or engaged by a user while gripping a handle (e.g., 110*a* or 110*b*).

Figure 8:
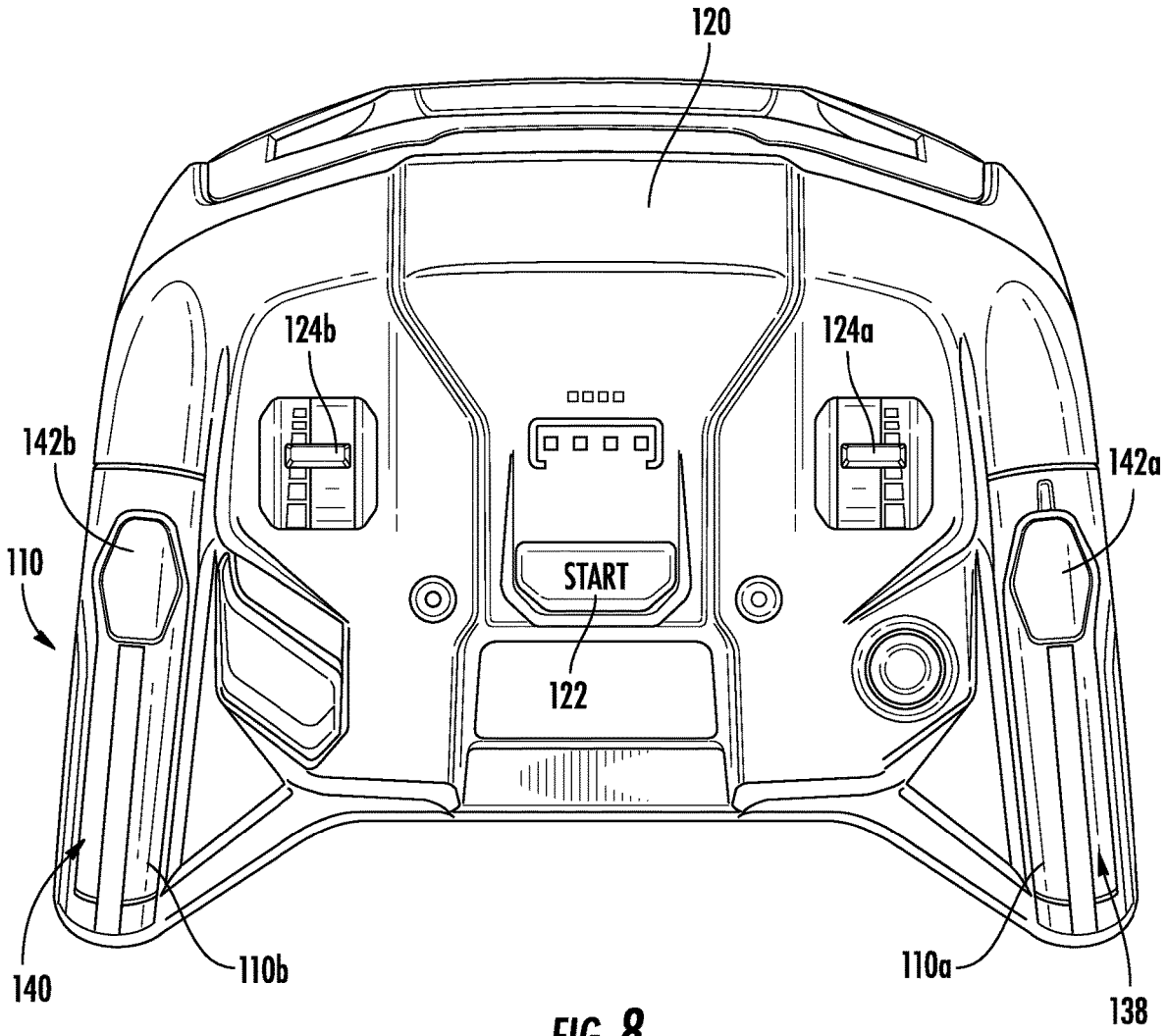
FIG. 8 is a top plan view of a portion of a snow thrower, including a control platform, according to further exemplary embodiments of the present disclosure.

Turning now briefly to FIG. 8, further embodiments of snow thrower 100 (FIG. 1) include a control panel 120 and handle assembly 110 having two discrete tool activation switches 142*a*, 142*b*. For instance, the first gripping area 138 may include a first tool activation switch 142*a* which is moveable relative to the handle assembly 110, and more particularly moveable relative to the first handle 110*a* of the handle assembly 110. Similarly, the second gripping area 140 may include a second tool activation switch 142*b* which is moveable relative to the handle assembly 110, and more particularly moveable relative to the second handle 110*b* of the handle assembly 110. As described above in the context of single activation switch 142, each tool activation switch 142*a*, 14*b* (e.g., the movement thereof) defines at least two discrete positions, including a disengaged position and an engaged position. Moreover, each switch 142*a*, 142*b* may be independently movable relative to the other (i.e., mechanically independent).

The tool activation switches 142*a*, 142*b* can advantageously direct one or more operational aspects of the snow thrower 100.

As an example, with respect to the first tool activation switch 142*a*, engagement with the first tool activation switch 142*a* can direct or initiate rotation of the auger 106 or rotation of the wheels 114. Optionally, actuating the first tool activation switch 142*a* to the engaged position can engage the auger 106 and wheels 114 to both rotate. Alternatively, actuating the first tool activation switch 142*a* to the engaged position can engage the wheels 114 alone to rotate (e.g., according to or based on the position of a wheel speed input 124*b*). As describe above, the speed or direction of the auger 106 and wheels 114 can be dictated, for instance, by the relative position of the element speed input 124*a* and the wheel speed input 124*b*, respectively. Optionally, one of the auger 106 and the wheels 114 can continue to rotate until the first tool activation switch 142*a* is released or returned to the disengaged position (or otherwise moved from the engaged position). Additionally or alternatively, both of the auger 106 and the wheels 114 can continue to rotate until the first tool activation switch 142*a* is released or returned to the disengaged position (or otherwise moved from the engaged position). Further additionally or alternatively, one or both of the auger 106 and the wheels 114 can continue to rotate as long as one of the first tool activation switch 142*a* and the second tool activation switch 142*b* is engaged and continue to do so until both the first tool activation switch 142*a* and the second tool activation switch 142*a* are released or returned to the disengaged position (or otherwise moved from the engaged position).

As an addition or alternative example, with respect to the second tool activation switch 142*b*, engagement with the second tool activation switch 142*b* can direct or initiate rotation of the auger 106 or rotation of the wheels 114 (e.g., the opposite of the one directed or initiated by engagement with the first tool activation switch 142*a*). Optionally, actuating the second tool activation switch 142*b* to the engaged position can engage the auger 106 and wheels 114 to both rotate. Alternatively, actuating the second tool activation switch 142*b* to the engaged position can engage the wheels 114 alone to rotate (e.g., according to or based on the position of a wheel speed input 124*b*). As describe above, the speed or direction of the auger 106 and wheels 114 can be dictated, for instance, by the relative position of the element speed input 124*a* and the wheel speed input 124*b*, respectively. Optionally, one of the auger 106 and the wheels 114 can continue to rotate until the second tool activation switch 142*b* is released or returned to the disengaged position (or otherwise moved from the engaged position). Additionally or alternatively, both of the auger 106 and the wheels 114 can continue to rotate until the second tool activation switch 142*b* is released or returned to the disengaged position (or otherwise moved from the engaged position). Further additionally or alternatively, one or both of the auger 106 and the wheels 114 can continue to rotate as long as one of the second tool activation switch 142*b* and the first tool activation switch 142*a* is engaged and continue to do so until both the second tool activation switch 142*b* and the first tool activation switch 142*a* are released or returned to the disengaged position (or otherwise moved from the engaged position).

It is noted that the tool activation switches 142*a*, 142*b* may be similar in construction and mechanical movement to the above-described single activation switch 142. Nonetheless, it is further noted that the tool activation switches 142*a*, 142*b* are illustrated as buttons having a linear range of motion, as opposed to paddles having a pivotable range of motion. As would be understood, however, the general movement and selective engagement with a corresponding activation sensor (not shown) would be similar to that of the above-described single activation switch 142. Activation switch 142*a* is understood to be actuatable or engaged by a user while gripping a handle (e.g., 110*a*) while activation switch 142*b* is understood to be actuatable or engaged by a user while gripping a handle (e.g., 110*b*). Moreover, switches 142*a*, 142*b* may be provided as another suitable input (e.g., having a set range of motion between a disengaged position and an engaged position), such as a button, twist-grip or twist throttle, or bail.

Now that the construction of a power tool (e.g., snow thrower 100) according to exemplary embodiments have been presented, exemplary methods (e.g., method 500) of operating a power tool will be described. Although the above discussion is primarily directed to the details of a snow thrower, one skilled in the art will appreciate that the exemplary method 500 is applicable to the operation of a variety of other power tools, such as self-propelled lawnmower tools having separately driven or rotated elements (e.g., one or more blades and wheels). In exemplary embodiments, the various method steps as disclosed herein may be performed (e.g., in whole or part) by controller 150.

Figure 5:
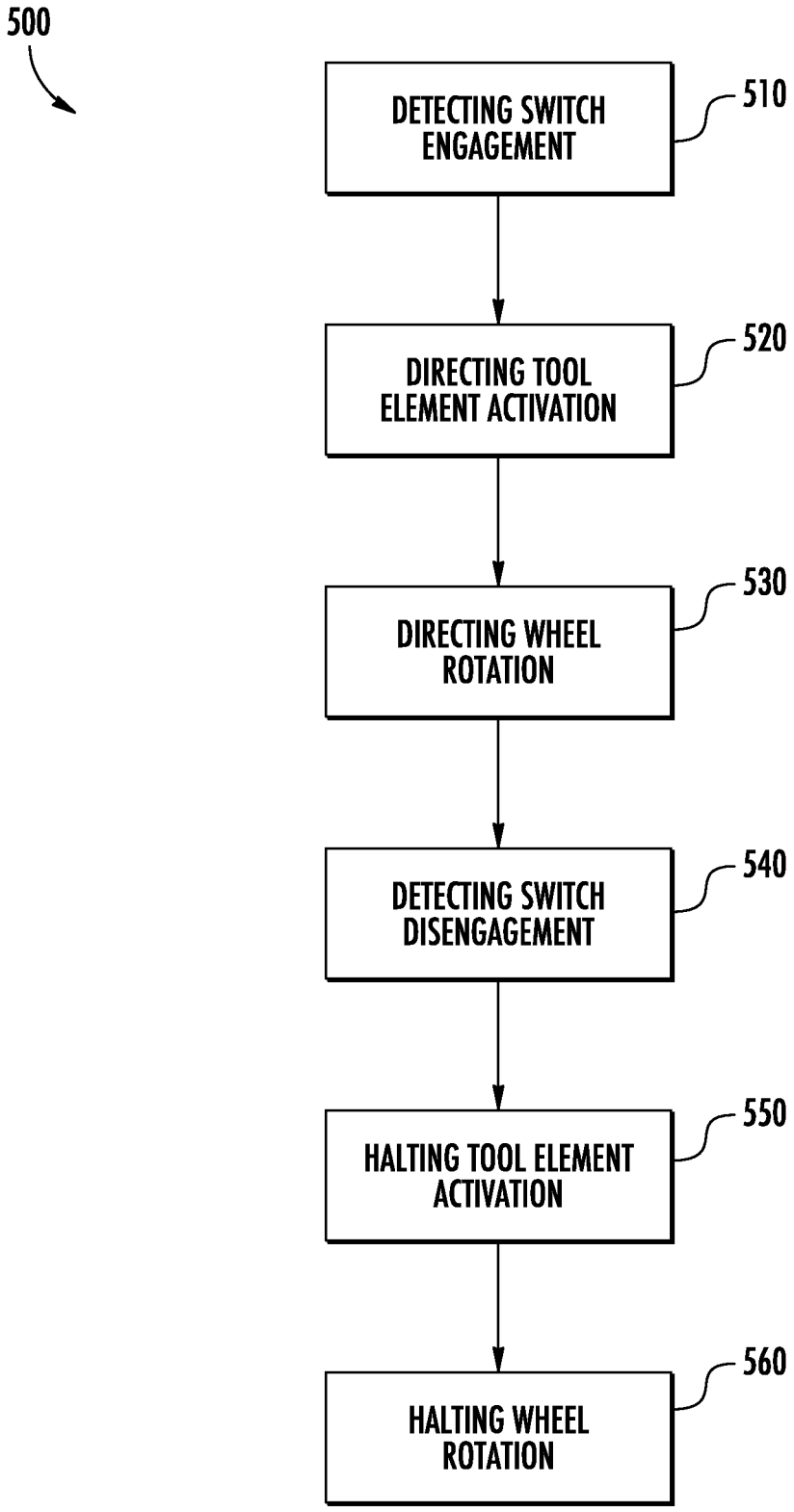
FIG. 5 is a flow chart illustrating a method of operating a power tool in accordance with embodiments of the present disclosure.

FIG. 5 depicts steps performed in a particular order for purpose of illustration and discussion. Those of ordinary skill in the art, using the disclosures provided herein and except as otherwise indicated, will understand that the steps of the method 500 can be modified, adapted, rearranged, omitted, interchanged, or expanded in various ways without deviating from the scope of the present disclosure.

Advantageously, methods in accordance with the present disclosure may provide a single activation control for multiple elements or may otherwise improve durability, assembly, or safety of a power tool.

At 510, the method 500 includes detecting switch engagement, such as at the single tool activation switch. For instance, it may be detected that the single tool activation switch is in (or has been moved to) the engaged position. As described above, detection may correspond to a signal received from an activation sensor in operative communication with single tool activation switch. Thus, a signal may be transmitted and received to indicate a user has engaged the single tool activation switch, such as by grabbing the single tool activation switch on the first handle.

In some embodiments, 510 includes detecting switch engagement at one or both of the first and second tool activation switches (e.g., in embodiments including such switches). For instance, it may be detected that the first tool activation switch is in (or has been moved to) the engaged position. Additionally or alternatively, it may be detected that the second tool activation switch is in (or has been moved to) the engaged position. Thus, one or more signals may be transmitted and received to indicate a user has engaged either or both of the first and second tool activation switches, such as by grabbing the first tool activation switch on the first handle or the second tool activation switch on the second handle.

At 520, the method 500 includes directing the tool element (e.g., auger) activation. In some embodiments, the tool or auger motor is directed to activate or rotate the tool or auger in response to detecting switch engagement at the single tool activation switch. Thus, engagement with the single tool activation switch may prompt activation or rotation of the auger. Optionally, activation may continue while the single tool activation switch remains engaged (i.e., in the engaged position). In certain embodiments, rotation of the tool (e.g., rotational speed of the tool) is based on a corresponding tool or element speed input. For instance, a position sensor may detect the position of the element speed input. Thus, a signal may be transmitted and received to indicate where the element speed input is along its set range of motion. Moreover, the tool or auger may be directed according to a set speed or power draw that corresponds to the detected position of the element speed input. In turn, once a user has engaged the single tool activation switch, the element speed input may be moved in order to adjust the speed at which the tool rotates. In other words, although the single tool activation switch may prompt the tool to rotate, the speed at which the tool actively rotates may be determined (at least in part) by the position of the element speed input.

In some embodiments, 520 includes directing the tool or auger motor in response to detecting switch engagement at the first tool activation switch or the second tool engagement switch (e.g., in embodiments including such switches). Thus, engagement with the either the first or second tool activation switch (e.g., exclusively or, alternatively, inclusively) may prompt activation or rotation of the auger. Optionally, activation may continue while the corresponding tool activation switch (e.g., one of the first tool activation switch and the second tool activation switch) remains engaged (i.e., in the engaged position). Alternatively, activation may continue while either one of the tool activation switches remains engaged (i.e., in the engaged position). In certain embodiments, rotation of the tool (e.g., rotational speed of the tool) is based on a corresponding tool or element speed input. For instance, a position sensor may detect the position of the element speed input. Thus, a signal may be transmitted and received to indicate where the element speed input is along its set range of motion. Moreover, the tool or auger may be directed according to a set speed or power draw that corresponds to the detected position of the element speed input. In turn, once a user has engaged the first or second tool activation switch, the element speed input may be moved in order to adjust the speed at which the tool rotates. In other words, although the one or both of the first and second tool activation switches may prompt the tool to rotate, the speed at which the tool actively rotates may be determined (at least in part) by the position of the element speed input.

At 530, the method 500 includes directing wheel rotation. Optionally (e.g., simultaneously to or in tandem with at least a portion of 520 such activation of the tool element and wheel rotation overlaps). In some embodiments, the wheel motor is directed to activate or rotate the driven wheels in response to detecting switch engagement at the single tool activation switch. Thus, engagement with the single tool activation switch may prompt activation or rotation of the wheels. Optionally, activation may continue while the single tool activation switch remains engaged (e.g., in the engaged position). In certain embodiments, rotation of the wheels (e.g., rotational speed of the wheels) is based on a corresponding wheel speed input. For instance, a position sensor may detect the position of the wheel speed input. Thus, a signal may be transmitted and received to indicate where the wheel speed input is along its set range of motion. Moreover, the wheels may be directed according to a set speed or power draw that corresponds to the detected position.

In some embodiments, 530 includes directing the wheel motor in response to detecting switch engagement at the first tool activation switch or the second tool engagement switch (e.g., in embodiments including such switches). Thus, engagement with the either the first or second tool activation switch (e.g., exclusively or, alternatively, inclusively) may prompt activation or rotation of the wheels. Optionally, activation may continue while the corresponding tool activation switch (e.g., one of the first tool activation switch and the second tool activation switch) remains engaged (i.e., in the engaged position). Alternatively, activation may continue while either one of the tool activation switches remains engaged (i.e., in the engaged position). In certain embodiments, rotation of the wheels (e.g., rotational speed of the wheels) is based on a corresponding wheel speed input. For instance, a position sensor may detect the position of the wheel speed input. Thus, a signal may be transmitted and received to indicate where the wheel speed input is along its set range of motion. Moreover, the wheels may be directed according to a set speed or power draw that corresponds to the detected position of the wheel speed input. In turn, once a user has engaged the first or second tool activation switch, the wheel speed input may be moved in order to adjust the speed at which the wheels rotates. In other words, although the one or both of the first and second tool activation switches may prompt the wheels to rotate, the speed at which the wheels actively rotates may be determined (at least in part) by the position of the wheel speed input.

As noted above, a reverse position or neutral position may further be provided. In turn, once a user has engaged the single tool activation switch, the wheel speed input may be moved in order to adjust the speed at which the wheels rotate, the direction (e.g., forward or reverse) at which the wheels rotate, or whether the wheels actively rotate. In other words, although the tool activation switch(es) may prompt the wheels to rotate, the speed or direction at which the wheels actively rotates may be determined (at least in part) by the position of the wheel speed input. Moreover, the wheels may be set to a neutral (e.g., free-rolling) setting even while the tool or auger continues to rotate. In some embodiments, positioning the wheel speed input to the neutral position or reverse position may prevent activation of the tool element (e.g., in step 520). In other words, the method 500 may include detecting the wheel speed input in the neutral position or the reverse position and restricting activation of the tool element in response to detecting the wheel speed input in the neutral position or the reverse position. As an example, power to the element motor may be prevented or otherwise stopped when the wheel speed input is moved to the neutral position or reverse position. Notably, restricting activation of the tool element in response to detecting the wheel speed input in the neutral position or the reverse position may enhance safety or preserve power in the power tool.

At 540, the method 500 includes detecting switch disengagement (e.g., of the single tool activation switch). For instance, following 510, it may be detected that the single tool activation switch has been moved to the disengaged position or is otherwise no longer in the engaged position. As described above, detection may correspond to a signal received from an activation sensor in operative communication with single tool activation switch. Thus, a signal may be transmitted and received (or an active signal may be halted) to indicate a user has released the single tool activation switch, such as by letting go or lifting a hand off of the single tool activation switch on the first handle.

In some embodiments, 540 includes detecting switch disengagement at one or both of the first and second tool activation switches (e.g., in embodiments including such switches). For instance, following 510, it may be detected that the first tool activation switch has been moved to the disengaged position or is otherwise no longer in the engaged position. Additionally or alternatively, it may be detected that the second tool activation switch has been moved to the disengaged position or is otherwise no longer in the engaged position. Thus, one or more signals may be transmitted and received to indicate a user has released either or both of the first and second tool activation switches, such as by letting go or lifting a hand off the first handle or the second tool activation switch on the second handle.

At 550, the method 500 includes halting tool element activation (e.g., in response to detecting disengagement at the single tool activation switch). As an example, power to the element motor may be prevented or otherwise stopped. Thus, disengagement with the single tool activation switch may prompt the tool or auger to stop actively rotating. Optionally, prevention of activation may continue while the single tool activation switch remains disengaged (e.g., in the disengaged position or otherwise in a position other than the engaged position).

In some embodiments, 550 includes halting tool element activation in response to detecting switch disengagement at the first tool activation switch or the second tool engagement switch (e.g., in embodiments including such switches). Thus, disengagement with the either the first or second tool activation switch (e.g., exclusively or, alternatively, inclusively) may prompt the tool or auger to stop actively rotating. Optionally, prevention of activation may continue while the corresponding tool activation switch (e.g., one of the first tool activation switch and the second tool activation switch) remains disengaged (e.g., in the disengaged position or otherwise in a position other than the engaged position), thereby permitting activation of the wheels when the tool activation corresponding to the tool element is disengaged. Alternatively, prevention of activation may continue while either one of the tool activation switches remains disengaged (i.e., in the disengaged position), thereby permitting the wheels to continue rotating while preventing rotation of the tool element if either one of the first and second tool activation switch is engaged while the other of the first and second tool activation switch is disengaged. Further alternatively, prevention of activation may continue only while both the first and second tool activation switches remains disengaged (e.g., in the disengaged position or otherwise in a position other than the engaged position), thereby permitting the wheels and tool element to both continue rotating if either one of the first and second tool activation switch is engaged while the other of the first and second tool activation switch is disengaged.

The halted power draw at 550 may be made regardless of the position of the element speed input.

At 560, the method 500 includes halting wheel rotation (e.g., simultaneously to or in tandem with 550). As an example, power to the wheel motor may be prevented or otherwise stopped. Thus, disengagement with the single tool activation switch may prompt the wheels to stop actively rotating. Optionally, prevention of activation may continue while the single tool activation switch remains disengaged (e.g., in the disengaged position or otherwise in a position other than the engaged position).

In some embodiments, 560 includes halting wheel rotation in response to detecting switch disengagement at the first tool activation switch or the second tool engagement switch (e.g., in embodiments including such switches). Thus, disengagement with the either the first or second tool activation switch (e.g., exclusively or, alternatively, inclusively) may prompt the wheels to stop actively rotating. Optionally, prevention of activation may continue while the corresponding tool activation switch (e.g., one of the first tool activation switch and the second tool activation switch) remains disengaged (e.g., in the disengaged position or otherwise in a position other than the engaged position), thereby preventing activation of the wheels irrespective of the position of the other of the first tool activation switch and the second tool activation switch. Alternatively, prevention of activation may continue while either one of the tool activation switches remains disengaged (i.e., in the disengaged position), thereby preventing the wheels from rotating while if either one of the first and second tool activation switch is disengaged. Further alternatively, prevention of activation may continue only while both the first and second tool activation switches remains disengaged (e.g., in the disengaged position or otherwise in a position other than the engaged position), thereby permitting the wheels to both continue rotating if either one of the first and second tool activation switch is engaged irrespective of whether the other of the first and second tool activation switch is disengaged. The halted power draw at 550 may be made regardless of the position of the element speed input.

The halted power draw at 560 may be made regardless of the position of the wheel speed input. In some embodiments, wheel rotation may halt upon disengagement of the single tool activation switch slightly before tool element activation is halted by the same disengagement, or vice versa.

Further aspects of the invention are provided by one or more of the following embodiments:

Embodiment 1. A method of operating a snow thrower comprising a frame, a rotatable auger mounted to the frame, one or more drive wheels mounted to the frame apart from the auger, and a single tool activation switch held above the drive wheels, the method comprising: detecting switch engagement at the single tool activation switch; directing auger rotation for the rotatable auger in response to detecting switch engagement; and directing wheel rotation for the drive wheels in response to detecting switch engagement.

Embodiment 2. The method of any one or more of the embodiments, wherein directing auger rotation is based on an element speed input movably mounted on a control platform attached to the frame.

Embodiment 3. The method of any one or more of the embodiments, wherein directing wheel rotation is based on a wheel speed input movably mounted on a control platform attached to the frame.

Embodiment 4. The method of any one or more of the embodiments, wherein the wheel speed input defines a forward speed range, reverse speed range, and a neutral position.

Embodiment 5. The method of any one or more of the embodiments, wherein directing auger rotation comprises activating an auger motor supported on the frame, and wherein directing wheel rotation comprises activating a wheel motor supported on the frame apart from the auger motor.

Embodiment 6. The method of any one or more of the embodiments, wherein the snow thrower further comprises a first and a second handle extending separately from the frame, and wherein the single tool activation switch is movably mounted to the first handle and spaced apart from the second handle.

Embodiment 7. The method of any one or more of the embodiments, wherein the single tool activation switch is pivotably mounted to the first handle, and wherein detecting switch engagement comprises detecting the single tool activation switch in an engaged position defining a minimum distance between the single tool activation switch and the first handle, the engaged position being distinct from a disengaged position and defining a maximum distance between the single tool activation switch and the first handle.

Embodiment 8. The method of any one or more of the embodiments, further comprising: detecting switch release at the single tool activation switch; halting auger rotation in response to detecting switch release; and halting wheel rotation in response to detecting switch release.

Embodiment 9. A method of operating a power tool comprising a frame, a rotatable work element mounted to the frame, and one or more drive wheels mounted to the frame apart from the work element, the method comprising: detecting switch engagement at a single tool activation switch; directing element rotation for the work element in response to detecting switch engagement; and directing wheel rotation for the drive wheels in response to detecting switch engagement.

Embodiment 10. The method of any one or more of the embodiments, wherein directing auger rotation is based on an element speed input movably mounted on a control platform attached to the frame.

Embodiment 11. The method of any one or more of the embodiments, wherein directing wheel rotation is based on a wheel speed input movably mounted on a control platform attached to the frame.

Embodiment 12. The method of any one or more of the embodiments, wherein the wheel speed input defines a forward speed range, reverse speed range, and a neutral position.

Embodiment 13. The method of any one or more of the embodiments, wherein directing element rotation comprises activating an element motor supported on the frame, and wherein directing wheel rotation comprises activating a wheel motor supported on the frame apart from the element motor.

Embodiment 14. The method of any one or more of the embodiments, wherein the snow thrower further comprises a first and a second handle extending separately from the frame, and wherein the single tool activation switch is movably mounted to the first handle and spaced apart from the second handle.

Embodiment 15. The method of any one or more of the embodiments, wherein the single tool activation switch is pivotably mounted to the first handle, and wherein detecting switch engagement comprises detecting the single tool activation switch in an engaged position defining a minimum distance between the single tool activation switch and the first handle, the engaged position being distinct from a disengaged position and defining a maximum distance between the single tool activation switch and the first handle.

Embodiment 16. The method of any one or more of the embodiments, further comprising: detecting switch release at the single tool activation switch; halting element rotation in response to detecting switch release; and halting wheel rotation in response to detecting switch release.

Embodiment 17. A power tool comprising: a frame; a rotatable work element mounted to the frame; one or more drive wheels mounted to the frame apart from the rotatable work element; an element speed lever input attached to the frame above the drive wheels; a wheel speed lever input attached to the frame above the drive wheels; a single tool activation switch spaced apart from the element and wheel speed lever inputs; and a controller in operative communication with the element speed lever input, the wheel speed lever input, and the single tool activation switch, the controller being configured to direct an operation routine comprising: detecting engagement at the single tool activation switch, directing element rotation for the work element based on the element speed lever input in response to detecting switch engagement, and directing wheel rotation for the drive wheels based on the wheel speed lever input in response to detecting switch engagement based on the wheel speed lever input.

Embodiment 18. The power tool of any one or more of the embodiments, wherein the wheel speed lever input defines a forward speed range, reverse speed range, and a neutral position.

Embodiment 19. The power tool of any one or more of the embodiments, wherein directing element rotation comprises activating an element motor supported on the frame, and wherein directing wheel rotation comprises activating a wheel motor supported on the frame apart from the element motor.

Embodiment 20. The power tool of any one or more of the embodiments, further comprising a first and a second handle extending separately from the frame, wherein the single tool activation switch is movably mounted to the first handle and spaced apart from the second handle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A method of operating a snow thrower comprising a frame, a rotatable auger mounted to the frame, one or more drive wheels mounted to the frame apart from the rotatable auger, and a single user-activated tool activation switch held above the drive wheels, the method comprising:

detecting switch engagement by a user at the single user-activated tool activation switch based on a signal received from an activation sensor in operative communication with the single user-activated tool activation switch;

directing, by a controller, auger rotation for the rotatable auger in response to detecting switch engagement; and directing, by the controller, wheel rotation for the drive wheels in response to detecting switch engagement.

2. The method of claim 1, wherein directing auger rotation is based on an element speed input movably mounted on a control platform attached to the frame.

3. The method of claim 1, wherein directing wheel rotation is based on a wheel speed input movably mounted on a control platform attached to the frame.

4. The method of claim 3, wherein the wheel speed input defines a forward speed range, reverse speed range, and a neutral position.

5. The method of claim 1, wherein directing auger rotation comprises activating an auger motor supported on the frame, and wherein directing wheel rotation comprises activating a wheel motor supported on the frame apart from the auger motor.

6. The method of claim 1, wherein the snow thrower further comprises a first and a second handle extending separately from the frame, and wherein the single user-activated tool activation switch is movably mounted to the first handle and spaced apart from the second handle.

7. The method of claim 6, wherein the single user-activated tool activation switch is pivotably mounted to the first handle, and wherein detecting switch engagement comprises detecting the single user-activated tool activation switch in an engaged position defining a minimum distance between the single user-activated tool activation switch and the first handle, the engaged position being distinct from a disengaged position and defining a maximum distance between the single user-activated tool activation switch and the first handle.

8. The method of claim 1, further comprising:

detecting switch release at the single user-activated tool activation switch;

halting auger rotation in response to detecting switch release; and halting wheel rotation in response to detecting switch release.

9. A method of operating a power tool comprising a frame, a rotatable work element mounted to the frame, and one or more drive wheels mounted to the frame apart from the rotatable work element, the method comprising:

detecting switch engagement by a user at a single user-activated tool activation switch based on a signal received from an activation sensor in operative communication with the single user-activated tool activation switch;

directing, from a controller, element rotation for the rotatable work element in response to detecting switch engagement; and directing, from the controller, wheel rotation for the drive wheels in response to detecting switch engagement.

10. The method of claim 9, wherein directing element rotation is based on an element speed input movably mounted on a control platform attached to the frame.

11. The method of claim 9, wherein directing wheel rotation is based on a wheel speed input movably mounted on a control platform attached to the frame.

12. The method of claim 11, wherein the wheel speed input defines a forward speed range, reverse speed range, and a neutral position.

13. The method of claim 9, wherein directing element rotation comprises activating an element motor supported on the frame, and wherein directing wheel rotation comprises activating a wheel motor supported on the frame apart from the element motor.

14. The method of claim 9, wherein the power tool further comprises a first and a second handle extending separately from the frame, and wherein the single user-activated tool activation switch is movably mounted to the first handle and spaced apart from the second handle.

15. The method of claim 14, wherein the single user-activated tool activation switch is pivotably mounted to the first handle, and wherein detecting switch engagement comprises detecting the single user-activated tool activation switch in an engaged position defining a minimum distance between the single user-activated tool activation switch and the first handle, the engaged position being distinct from a disengaged position and defining a maximum distance between the single user-activated tool activation switch and the first handle.

16. The method of claim 9, further comprising:

detecting switch release at the single user-activated tool activation switch;

halting element rotation in response to detecting switch release; and halting wheel rotation in response to detecting switch release.

17. A power tool comprising:

a frame;

a rotatable work element mounted to the frame;

one or more drive wheels mounted to the frame apart from the rotatable work element;

an element speed input attached to the frame above the drive wheels;

a wheel speed input attached to the frame above the drive wheels;

a single user-activated tool activation switch spaced apart from the element and wheel speed inputs; and a controller in operative communication with the element speed input, the wheel speed input, and the single user-activated tool activation switch, the controller being configured to direct an operation routine comprising:

detecting switch engagement by a user at the single user-activated tool activation switch based on a signal received from an activation sensor in operative communication with the single user-activated tool activation switch, directing, by the controller, element rotation for the rotatable work element based on the element speed input in response to detecting switch engagement, and directing, by the controller, wheel rotation for the drive wheels based on the wheel speed input in response to detecting switch engagement based on the wheel speed input.

18. The power tool of claim 17, wherein the wheel speed input defines a forward speed range, reverse speed range, and a neutral position.

19. The power tool of claim 17, wherein directing element rotation comprises activating an element motor supported on the frame, and wherein directing wheel rotation comprises activating a wheel motor supported on the frame apart from the element motor.

20. The power tool of claim 17, further comprising a first and a second handle extending separately from the frame, wherein the single tool activation switch is movably mounted to the first handle and spaced apart from the second handle.

* * * * *